United States Patent [19]

Mikulich, Jr. et al.

[11] 3,984,841

[45] Oct. 5, 1976

[54] BROADBAND ANTENNA SYSTEM WITH THE FEED LINE CONDUCTORS SPACED ON ONE SIDE OF A SUPPORT BOOM

[75] Inventors: Peter John Mikulich, Jr., Marlton; John David Callaghan, Cherry Hill, both of N.J.

[73] Assignee: RCA Corporation, New York, N.Y.

[22] Filed: Oct. 14, 1975

[21] Appl. No.: 622,014

[52] U.S. Cl. ..... 343/792.5; 343/814; 343/811

[51] Int. Cl.[2] ..... H01Q 11/10

[58] Field of Search ..... 343/792.5, 814, 811, 343/815

[56] References Cited

UNITED STATES PATENTS 3,482,250 12/1969 Maner ..... 343/811

3,653,056 4/1972 Peterson ..... 343/815

*Primary Examiner*—Craig E. Church

*Attorney, Agent, or Firm*—Edward J. Norton; Robert L. Troike

[57] ABSTRACT

A low cost broadband antenna system particularly suitable for television reception is described wherein the feed line includes a pair of conductors mounted in insulated manner one above the other above a support boom with the conductors having a fixed separation from each other and from the boom, a fixed conductor diameter and boom dimension maintaining a constant impedance along the line. Dipoles extend transverse the longitudinal axis of the boom and are symmetrically disposed about the axis with the dipole half elements on the same side of the axis successively connected alternately to the first and second conductors of the pair.

8 Claims, 11 Drawing Figures

BROADBAND ANTENNA SYSTEM WITH THE FEED LINE CONDUCTORS SPACED ON ONE SIDE OF A SUPPORT BOOM

BACKGROUND OF INVENTION

This invention relates to an improved multi-frequency antenna system and to an antenna system which is particularly suitable for reception of signals within the high VHF (very high frequency) television frequency band and low VHF television frequency band and to the reception of signals within the UHF (ultra high frequency) television frequency band. These VHF bands cover the frequencies from 54 – 88 megahertz (MHz) and from 174 – 216 MHz. The UHF band covers the frequencies from 470 MHz – 890 MHz. It is desirable that a single antenna system be provided that is effective over both of these VHF television frequency bands and the UHF television frequency band.

One technique for extending the bandwidth of a television antenna system is to provide a plurality of colinear center fed or driven dipole elements with the lowest frequency dipole element located at one end and higher frequency dipole elements aligned and progressing toward the opposite end with the whole system fed at one end. Appropriate spacing is provided between each of these dipole elements and an appropriate feed line arrangement is provided to obtain relatively good reinforcing effects between the separate elements and to provide a relatively good antenna system for the low VHF (54–88 MHz) television frequency band. The appropriate antenna feed arrangement in order to permit close spacing between the colinear dipole elements when feeding at one end of the system requires a transposition of the feed lines between these dipole elements. This transposition of the feed lines is accomplished in one arrangement in the prior art by crisscrossing the feed wires above the boom which results in variations in spacing and in impedance that can degrade the characteristics of the antenna response. Also, in the prior art, this has been achieved by feed lines extending symmetrically on opposite sides of the boom which leads to complex and costly feed line structures for coupling to the dipole elements extending on opposite sides of the boom. Also, in the art, there have been constructed complex support booms which effectively provide two transmission lines. This complex boom structure also leads to high cost in the construction of an antenna system.

As stated previously, it is also desirable that the antenna system be operational over the UHF television frequency band. Since it is desirable that the entire antenna system have but one lead from the television set to the antenna, it is desirable that the entire UHF and VHF antenna system have a single feed point. It is desirable, therefore, that the same feed line for the VHF elements be a continuation of the feed line for the UHF element or vice versa. It is, therefore, desirable that the transmission line feeding the UHF elements match the feed line portion which feed the VHF elements in a manner not to degrade the characteristics of the antenna response in either the UHF or VHF portion. It is also desirable that this manner of achieving match be provided using simple low cost construction.

SUMMARY OF INVENTION

Briefly, an improved low cost antenna system is provided by a feed line wherein a pair of conductors extend with the first conductor spaced above the second conductor relative to the boom to which the antenna dipoles are mounted. The first and second conductors of the feed line are spaced substantially parallel to each other and substantially parallel to the boom with the pair of conductors extending in a plane perpendicular to the boom. Each of the dipoles extend transverse the elongated axis of the boom and are symmetrically disposed about the axis with the dipole half elements of each dipole connected to a different one of the first and second conductors.

IN THE DRAWINGS

In the drawings, FIG. 1 is a plan view of a complete television antenna system employing the present invention.

DESCRIPTION OF PREFERRED EMBODIMENTS

Figure 1:
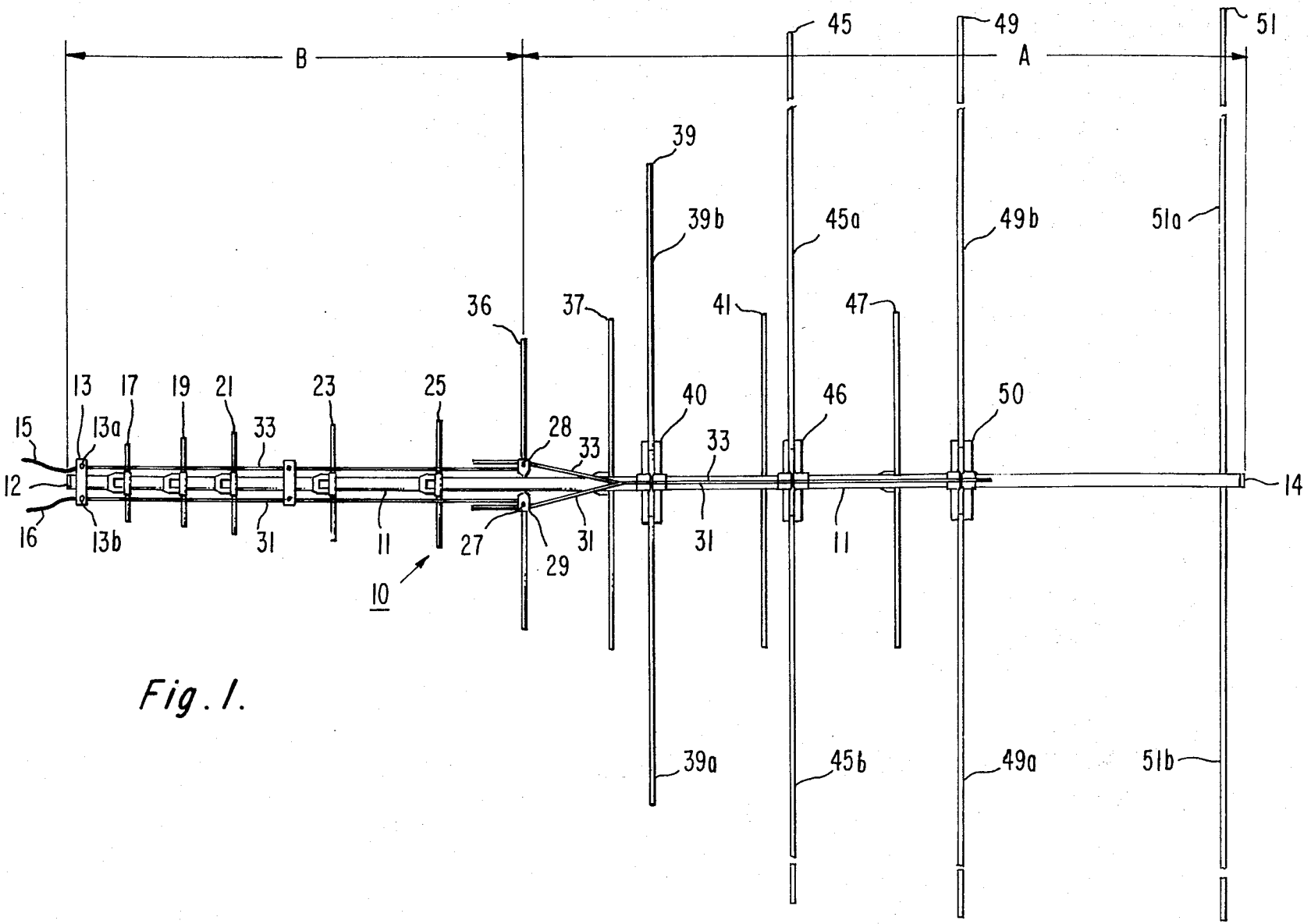
Figure 2:
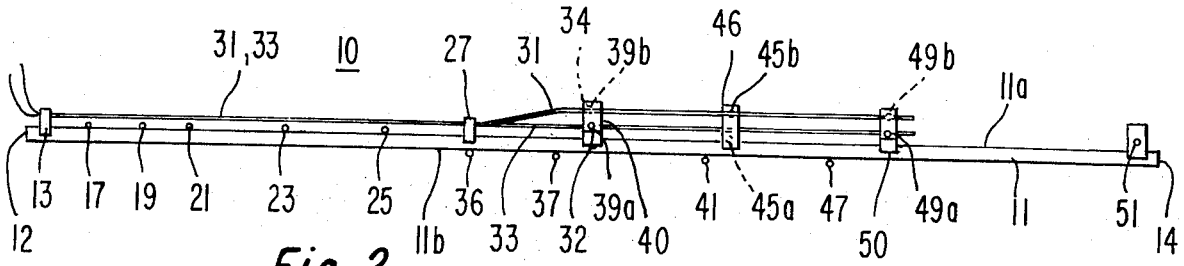
FIG. 2 is an elevational view of the antenna system in FIG. 1.

An embodiment of the invention is shown in FIGS. 1 and 2 as antenna system 10 having an electrically conductive boom 11 and a plurality of elements extending therefrom from the forward end 12 to the opposite end 14. The antenna system is divided into two sections, section A and section B. The elements in section A are the VHF (very high frequency) television frequency receiving elements. The VHF television frequency bands are from 54 – 88 Megahertz (MHz) and from 174 – 216 MHz. The band from 54 – 88 MHz is referred to as the low VHF band and the band from 174 – 216 is referred to as the high VHF band. The elements in group B provide reception in the UHF television frequency band from 470 to 890 MHz. The entire television antenna system is fed at the ultra high frequency end 12 at terminal block 13. The feed lines as represented by wires or conductors 15 and 16 are connected to terminals 13*a* and 13*b* of terminal block 13. The terminal block 13 is made of insulator material that is mounted to conductive boom 11. Conductive rod like elements 17, 19, 21, 23 and 25 are conductively mounted in space relation to each other to the broom 11. The elements 17, 19, 21, 23 and 25 are mounted so that when deployed for operation as shown in FIG. 1, the elements are orthogonal to the lengthwise axis of the boom 11 and in a common plane parallel to the top surface of boom 11. These elements 17, 19, 21, 23 and 25 may as illustrated in FIG. 1 include a swivel and locking mechanism that when they are deloyed they are locked orthogonal to the boom and when packaged for transport may be folded with their axis parallel to the boom. The conductive elements 17, 19, 21, and 25 are approximately a half wavelength long ($\lambda/2$) at a frequency within the UHF television band of frequencies, with the length of the elements becomming progressively longer toward end 14. Elements 23 and 25 are longer than elements 17, 19 and 21. Element 17 is of a length to be responsive to signals near the high end of the UHF television frequency band and element 25 is of a length to be responsive to signals near the low end of the UHF television frequency band. The elements 17, 19 and 21 are approximately one-quarter wavelength ($\lambda/4$) apart at a frequency within the high end of the UHF television frequency band and the elements 21, 23 and 25 are approximately one-half wavelength ($\lambda/2$) apart at a frequency within the low end of the UHF television frequency band. A feed line for the UHF elements is provided by wires or conductors 31 and 33 which extend from terminal block 13 at terminals 13*a* and 13*b* to a terminal block 27 at terminal points 28 and 29. The blocks 13 and 27 are arranged such that the conductors 31 and 33 extend parallel to each other in a plane parallel to the top surface of the boom 11 with the conductors 31 and 33 extending above the elements 17, 19, 21, 23 and 25 so as to be capacitively coupled to these elements. The conductors 31 and 33 are equally spaced from the boom along its length from terminal block 13 to terminal block 27. The conductors 31 and 33 are spaced from each other and from the boom 11 to provide a balanced transmission line having characteristic impedance of approximately 300 ohms.

The VHF section A comprises center fed dipoles 39, 45 and 49 and the passive elements 36, 37, 41, 47 and 51. In the VHF section, the conductor 33, between terminal 28 on block 27 and the feed point of dipole 39 bends inward toward a point 32 (See FIG. 2) above the center line of the boom 11. The conductor 31, between terminal 29 on block 27 and the feed point of dipole 39, bends upward and inward toward a point 34 above the center line of the boom 11 and directly above point 32. The conductors 31 and 33 between the feed points of the dipoles 39 and 49 are spaced one above the other above the boom 11 by element mounting assemblies 40, 46 and 50. These element mounting assemblies 40, 46 and 50 are of insulator material and are fixed to the boom. The dipoles 39, 45 and 49 are mounted to and supported by the respective assemblies 40, 46 and 50. The conductors 31 and 33 in the region between the dipoles 39 and 49 extend parallel to each other and the boom and to one side of the boom with the conductors in a plane that extends through the center line of the boom perpendicular to the top surface 11*a* of the boom 11. The spacing between conductors 31 and 33 and the spacing between these conductors 31 and 33 and the boom is selected to match the 300 ohm characteristic impedance of the line in section B. Although it is not normally desirable to have an unbalanced feed line as shown in section A where the conductors 31 and 33, which form the feed line are spaced different distances from the boom 11, it has been found that the capacitive effects of the center fed dipoles with respect to the boom minimize any difference in capacitance between the conductors 31 and 33 and the boom 11, and any unbalance associated therewith.

Figure 3:
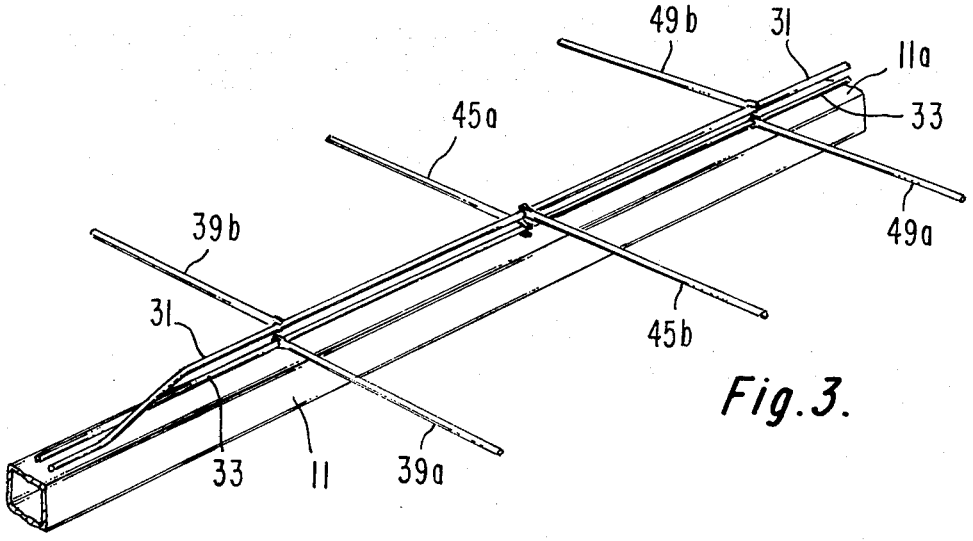
FIG. 3 is a sketch in perspective illustrating the relative position of the dipole elements, the transmission line and the support boom in the VHF portion of the antenna in FIG. 1.

The dipole half elements on the same side of the antenna axis are successively connected alternately to feed lines 31 and 33. In this way, a transposition is effected permitting closer spacing of the center fed dipoles. The dipole half element 39*a* of dipole 39 is connected to lower conductor 33 as indicated in FIGS. 2 and 3. As shown in FIGS. 2 and 3, the dipole half element 45*b* of dipole 45 extends in the same direction as the dipole half element 39*a* but is connected to the upper conductor 31. The dipole half element 45*a* of dipole 45 extends in the same direction as dipole half element 39*b* of dipole 39 and is connected to lower conductor 33. The dipole half element 49*a* of dipole 49 extends in the direction of dipole half elements 39*a* and 45*b* and is coupled to lower conductor 33. The dipole half element 49*b* of dipole 49 extends in the same direction as dipole half elements 39*b* and 45*a* and is connected to upper conductor 31. The transposition of the feed line provided by the above arrangement causes reinforcing effects between the dipoles 39, 45 and 49. The dipole 39 is approximately one wavelength ($\lambda$) long between the extreme extended ends of the dipole half elements 39*a* and 39*b* at a frequency slightly above 216 MHz and is nearly one-half wavelength ($\lambda/2$) long between extreme extended ends of the dipole half elements at a frequency between the high end of the low VHF television frequency band and the low end of the high VHF television frequency band.

A conductive director 37 is conductively mounted on the bottom 11*b* of boom 11 and is mounted close to and forward of the center fed VHF dipole 39. The director element 37 is arranged to be about one-half wavelength long at the extreme high end of the high VHF television frequency band. This element 37 acts to cause dipole 39 to become an efficient radiating element over a broad band of frequencies in the television frequency band. Also, an improved impedance match of the forwardmost VHF dipole 39 to the feed line made up of conductors 31 and 33 is provided by placing director 37 close to the feed point of this dipole 39. Dipoles 45 and 49 are dimensioned as half wavelength dipoles at frequencies within the low VHF television frequency bands. Only a portion of the dipoles 45 and 49 are shown in FIG. 1 for simplicity of illustration. Improved performance of the VHF antenna system over the entire high VHF television frequency band is provided by accommodation of the dipoles 45 and 49 with parasitic elements 41 and 47. The element 41 is mounted forward of and is closely spaced from center fed dipole 45. The element 41 in combination with center fed dipole 45 acts to provide improved reception in high VHF television frequency bands. Element 47 closely spaced forward of center fed dipole 49 as shown in FIGS. 1 and 2 provides further improvement in the operation over both the high and low VHF television frequency bands. The elements 41 and 47 are conductively mounted to the bottom 11*b* of the boom 11. Increased directivity in the forward direction or in the direction of end 12 of boom 11 is achieved by the proper placement of the reflector 51 at the end 14 of boom 11. The reflector 51 is made up of elements 51*a* and 51*b* conductively connected to the boom 11. The elements 37, 39, 41, 45, 47, 49 and 51 in their operating positions extend orthogonal to the lengthwise axis of the boom. The length of the element 51 from the extreme ends of rods 51*a* and 51*b* is constructed to be half wave resonant at a frequency slightly greater than that of the one-half wavelength at the lowest frequency of the VHF band of frequencies to be covered. Only a portion of rods 51*a* and 51*b* are shown in FIG. 1 for simplicity of illustration. An element 36 is conductively mounted orthogonal to boom 11 just below terminal block 28. This element 36 acts as a reflector in the UHF section B and as a director for signals at a frequency near the high end of the high VHF television frequency band.

Figure 4:
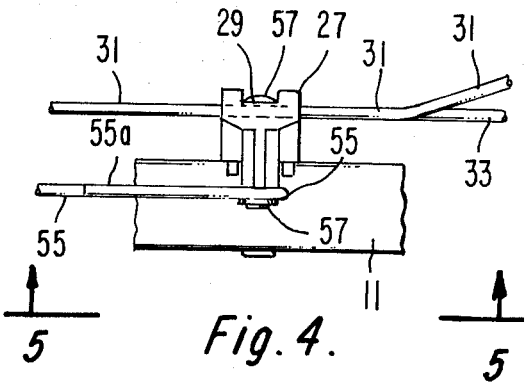
FIG. 4 is a side elevation view of the UHF decoupling portion of the antenna system in FIG. 1.
Figure 5:
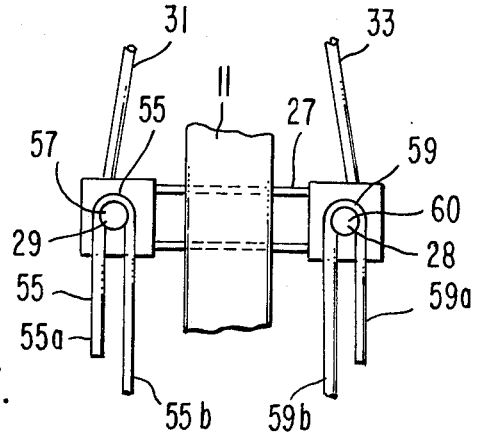
FIG. 5 is a view of the UHF decoupling portion of the antenna system in FIG. 1 taken along line 5 — 5 in FIG. 4.

The UHF portion may be decoupled from the VHF portion by an arrangement as illustrated in FIGS. 4 and 5. A hairpin shaped conductor 55 with one of the legs 55*a* being shorter than the other 55*b* is mounted to insulator terminal block 27 via a rivet 57 at terminal 29. The loop of the hairpin shaped conductor extends about the rivet 57. The conductor 21 is also electrically connected to rivet 57 at terminal 29. The lengths of legs 55*a* and 55*b* is one quarter wavelength long at frequencies near the high and low end respectively of the UHF band of televison frequencies. Likewise, hairpin shaped conducted 59 has shorter leg 59*a* and longer leg 59*b* and is mounted to insulator terminal block 27 via conductive rivet 60 at terminal 28. Rivet 60 is connected to conductors 33 and 59. The hairpin conductors 55 and 59 are mounted such that the legs are spaced parallel and close to each other such than an effective short circuit across terminals 28 and 29 at UHF frequencies occurs causing the decoupling of the UHF section B from the VHF section A of the antenna.

The feed line conductors 31 and 33 as shown in FIGS. 1 and 2 need not be continuous but the conductors 31 and 33 may each be made up of two sections connected electrically to each other at terminals 29 and 28. This mode of feeding is illustrated more particularly in FIGS. 6 and 11.

The above described antenna system makes for a simple low cost antenna system in several ways. In the first place, the cost of feeding the UHF elements is reduced by the proximity feeding which requires no connections to be made to the UHF elements and no insulators to separate the dipole halves. Secondly, by the nature of the two wires spaced on one side of the boom rather than the boom being split or one wire above the boom and the other wire below the boom permits easy and consequently, low cost feeding and transposition of the center fed VHF dipole elements. Further, the spacing between the feed line conductors is made essentially constant over each of section A and section B with only a single simple gradual change in the orientation and spacing of the conductors between the UHF section A and the feed point of the VHF dipole 39. This construction leads to a low cost and a well matched antenna system over the entire UHF and VHF television frequency bands.

An antenna system as described above was built and tested and proved to be efficiently operational over the UHF and VHF television frequency bands and had the following dimensions. The element 17 is 152.4 millimeters (mm) long and is spaced 107.95 mm from element 19. The element 19 is 177.8 mm long and is spaced 101.6 mm from element 21. Element 21 is 203.2 mm long and is spaced 190.5 mm from element 23. Element 23 is 228.6 mm long and is spaced 209.5 mm from element 25. Element 25 is 254 mm long and is located 165.1 mm from terminal 27. Terminal block 27 and director/reflector element 36 is spaced 177.8 mm from element 37. Director/reflector element 36 is 590.5 mm long. Element 37 is spaced 76.2 mm from the center feed point of center fed dipole element 39. The element 37 is 660.4 mm long. The dipole 39 is 1.28 meters (m) long between extreme ends of dipole half elements 39*a* and 39*b* and is spaced 279.4 mm from the next center fed dipole 45. The center fed dipole 45 is 1.828 m long between extreme ends of dipole halves 45*a* and 45*b*. The closely spaced parasitic 41 is 660.4 mm long and is spaced 57.15 mm in the direction of dipole 39 from dipole 45. The center fed dipole 49 is 2.489 m long between extreme ends of dipole half elements 49*a* and 49*b* and is spaced 330.2 mm from center fed dipole 45. The parasitic element 47 is 660.4 mm long and is spaced 127 mm from center fed dipole element 49. The reflector 51 is 2.743 mm long between extreme ends 51*a* and 51*b* and is spaced 580 mm from element 49. The parasitics 36, 37, 41 and 47 are positioned on the bottom side of the boom 11 to permit folding of these elements without interference with the center fed elements. In the VHF section A betwen dipoles 39 and 49, the lower conductor 33 is spaced 15.87 mm above the boom 11 and the upper conductor 31 is spaced in the same vertical plane 22.23 mm above conductor 33. In the UHF section B, the conductors 31 and 33 are spaced 56.97 mm apart with the conductors in a planne approximately 13.5 mm above a plane extending along the top surface 11*a* of the boom 11. The conductors 31 and 33 extend about 3.9 mm above the elements 17, 19, 21, 23 and 25. The boom 11 cross-sectional dimension is 2.54 centimeters (cm) by 2.54 cm.

Figure 6:
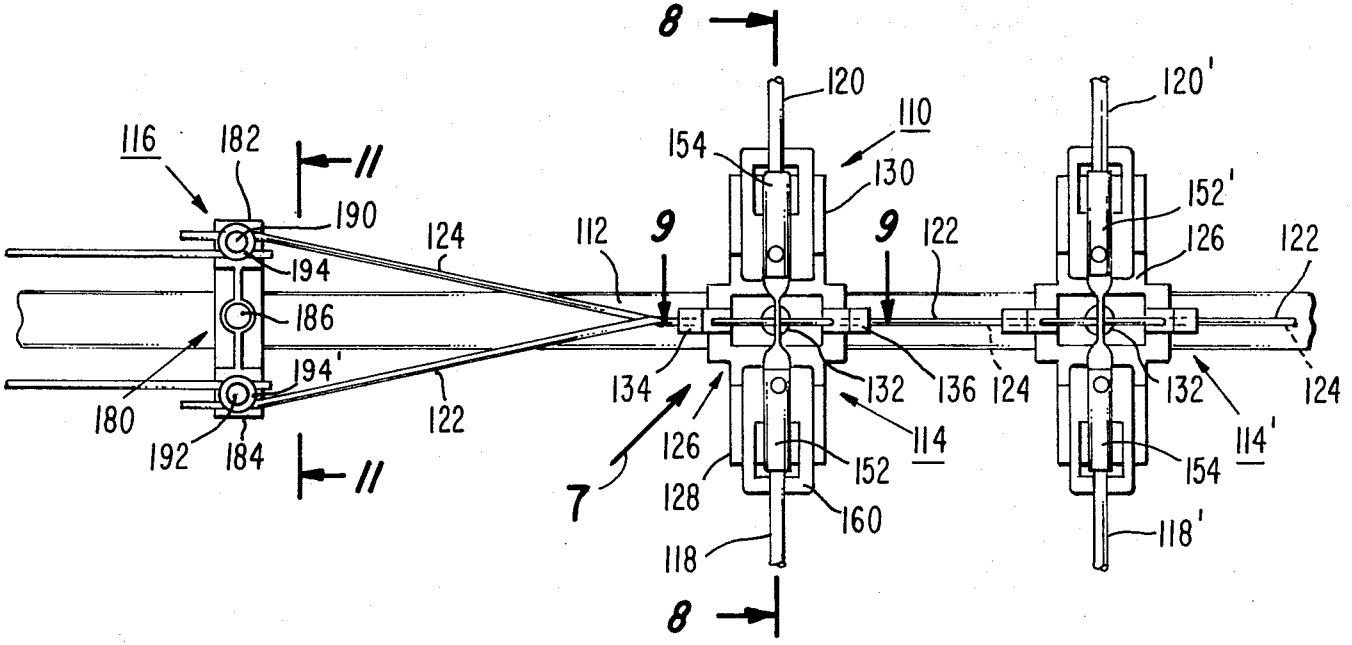
FIG. 6 is a plan view of a portion of an antenna system constructed and operated in accordance with an embodiment of the present invention.

In FIGS. 6 thru 11 to follow, a detailed description is presented as to the antenna construction of section A according to one preferred embodiment of the present invention which is the subject of a copending patent application filed concurrently herewith for Franklin Roosevelt Dimeo and William John Bachman, and entitled Antenna Construction. In FIG. 6, an antenna 110 constructed and operated in accordance with a preferred embodiment of the present invention includes a boom 112 and a plurality of dipole or signal receiving element mounting assemblies 114 and 114'. While two assemblies 114 and 114' are shown, in practice a much larger number of such assemblies are used as described previously. Also mounted on boom 112 is a feedthrough wire termination and support assembly 116. Element mounting assembly 114 is described in further detail with respect to FIGS. 7, 8 and 9, which description is typical of the description of the remaining element mounting assemblies such as the assembly 114'.

Boom 112 is a straight, elongated tubular member on which the assemblies 114 and 114' are mounted in axial spaced relationship. The boom 112 can be secured by suitable means (not shown) to an antenna support mast (not shown).

Mounted on and supported by the assembly 114 are a pair of dipole half elements 118 and 120 which are shown as extending outwardly from the boom 112. Mounted on assembly 114' are a pair of extending dipole half elements 120' and 118'. Elements 118, 120, 118' and 120' are suitable rods or tubes preferably of aluminum alloy. Only a portion of the rods 120, 120' 118 and 118' are shown in FIG. 6 for simplicity of illustration.

Disposed on one side of the boom are a pair of feedthrough wires 122 and 124 that extend one above the other with respect to boom 112 and extend in parallel spaced relationship through and between the various element mounting assemblies 114 and 114' along the boom longitudinal axis. Wires 122 and 124 are anchored mechanically and terminated electrically in the support assembly 116 at one end of the wires as is described in detail in connection with FIG. 11. The other ends of the wires 122 and 124 can be free standing. The wires 122, 124 are preferably 3.175 mm diameter aluminum rod and, thus, are relatively stiff and rigid.

As discussed previously in connection with FIGS. 2 and 3, the dipole elements such as elements 118, 120 or 118' and 120' are staggered electrically and mechanically so that the respective elements of a pair of elements, e.g. 120 and 118' are electrically connected to the respective feedthrough wire 122, and elements 118 and 120' are electrically connected to feedthrough wire 124. In addition, elements 120 and 118' lie in the same plane as feedthrough wire 122, while elements 120' and 118 lie in a lower different plane with feedthrough wire 124. The plane of wire 124 and elements 118 and 120' lies between boom 112 and wire 122.

Figure 7:
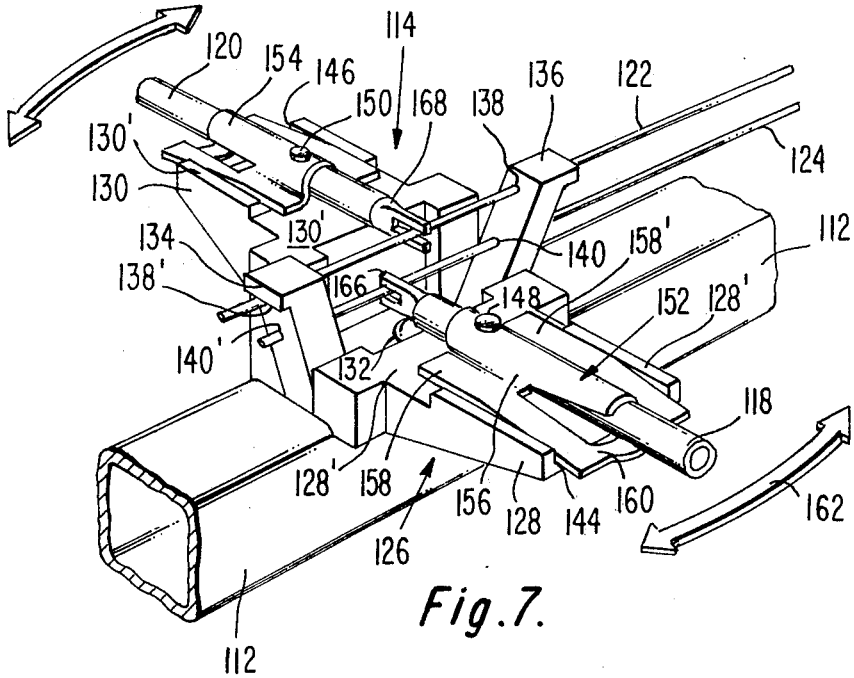
FIG. 7 is a perspective view of a portion of the construction of FIG. 6 taken in the direction of arrow 7.
Figure 8:
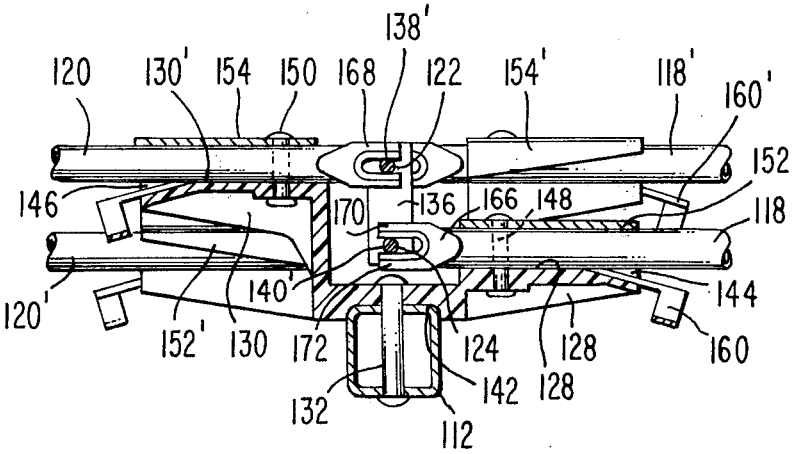
FIG. 8 is a partial section elevation view taken along line 8 — 8 in FIG. 6.
Figure 9:
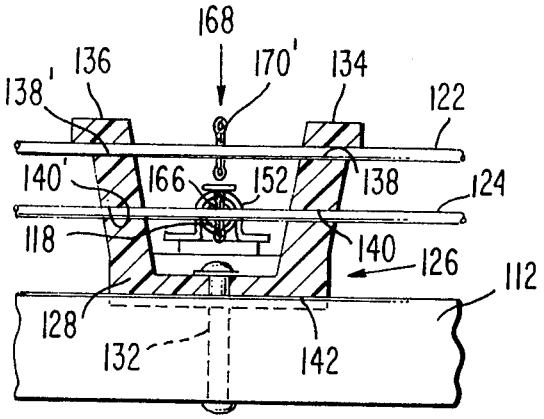
FIG. 9 is a partial sectional elevation view of the antenna construction of FIG. 6 taken along lines 9 — 9.

A typical mounting assembly 114 as shown in FIG. 7 will now be described. Riveted or otherwise firmly secured to boom 112 is a single, integral, unitary thermoplastic molded element mounting support 126. Support 126 is unique in that the identical piece 126 may be used to mount both the elements 120 and 118 of assembly 114 and also thee reversely oriented elements 120' and 118' of assembly 114'. Element mounting support 126 includes a pair of element support wings 128 and 130. Wings 128 and 130 have element support surfaces 128' and 130', respectively, on which are mounted the elements 118 and 120, respectively. Surfaces 128' and 130' are preferably parallel but disposed in different spaced planes which are spaced from boom 112. This is best seen in FIG. 8. Wings 128 and 130 are suitably ribbed to provide enhanced rigidity. Wings 128 and 130 extend away from boom 112 in diametrically opposite directions. Axially spaced from each other and extending from the base of the support 126 are a pair of upstanding feedthrough wire support stanchions 134 and 136. Each of stanchions 134 and 136 has a pair of suitable feedthrough wire support apertues 138', 140' and 138, 140 respectively, through which the respective wires 122 and 124 are passed. Apertures 138, 140 and 138', 140' are preferably molded into the stanchions. The fit of wires 122 and 124 in the respective apertures is not critical.

The molding of the stanchions 134 and 136 and wings 128 and 130 of the support 126 is conventional within the present state of the thermoplastic molding art. Apertures 138 and 140 of stanchion 136 are preferably axially aligned with the corresponding respective apertures 138' and 140' of stanchion 134, with the respective apertures spaced the same relative distance from the boom 112. In the exemplary embodiment, apertures 138 and 140 are spaced about 22.23 mm from each other in a direction normal to the boom 112. Aperture 140 is spaced about 15.8 mm from the boom 112 in this direction. This spacing is determinative of the electrical characteristics of the antenna.

Formed in support 126 is a suitable channel 142 which snuggly fits about thhe upper portion of boom 112 as best seen in FIG. 8. Surfaces 128' and 130' of wings 128 and 130, respectively, are disposed so that the respective elements 118 and 120 mounted on these surfaces are axially aligned with respective feedthrough wires 124 and 122 suspended between stanchions 134 and 136. The spacing between wires 122 and 124 of a given diameter and the spacing between the wires and boom 112 establishes the impedance of the feedthrough wires. These spacings are selected as discussed previously to provide optimum antenna performance. The longitudinal axes of the dipole halves 118 and 120 are respectively aligned with the longitudinal axes of the wires 122 and 124. In communication with surface 128' of wing 128 is a detent recess 144 which ramps outwardly and downwardly away from surface 128' to the extended end of wing 128. A similarly downwardly ramping recess 146 is formed in wing 130. The dipole halves 118 and 120 are pivotally secured to wings 128 and 130, respectively, by rivets 148 and 150. Suitable element retaining spring clips 152 and 154 are secured by the rivets 148 and 150 to the respective dipole halves 118 and 120 at tubular portion 156 to provide an element detent locking action. Clips 152 and 154 lock the dipole halves in the radially outwardly extending position via typical wing recess 144 and clip detent portion 160. Clips 152 and 154 are identical and are used on assemblies 114 and 114' and other similar assemblies on the antenna. Support 126 being made of a thermoplastic material electrically isolates each of the dipole halves 118 and 120, the boom 112 and the feedthrough wires 122 and 124 from each other. The portion of the wires 122 and 124 suspended between the stanchions 134 and 136 are relatively stiff and rigid for purposes to be explained.

In accordance with the present invention, a unique configuration is provided for each of the dipole halves 118, 120, 118' and 120' (FIG. 6) for connecting the dipole halves to the feedthrough wires 122 and 124. As seen in FIG. 8, this construction includes providing a yoke-shaped bifurcated end 166 and 168, respectively, for each of dipole halves 118 and 120. End 166 of dipole half 118 is typical of the inboard ends of each of the dipole halves on the antenna. Therefore, a description of end 166 only will be given herein. The axial depth of the bifurcation along the longitudinal axis of the element is made sufficiently great so that the two tines 170 and 172 forming the bifurcation are slightly resilient, for example, 0.25 mm, in the direction away from the wire 124 when the wire 124 is disposed there between. This resiliency permits an interference fit between wire 124 and tines 170 and 172. For purposes of illustration, the end 166 has a bifurcation axial depth of about 15.7 mm, nominally and a separation between the free ends of the tines of 2.4 mm. This results in an interference fit between the bifurcated end 166 and the feedthrough wire 124 of about 0.78 mm. The bifurcated ends may deform about 0.53 mm, leaving the 0.25 mm resiliency factor noted above. This resiliency provides enhanced electrical connection between the bifurcated end and the feedthrough wire by permitting repeated connections to be made without significantly wearing away the wire or the dipole half or otherwise detrimentally affecting the electrical connection therebetween. Under conditions where vibration might tend to impart relative movement between the end 166 and the wire 124, it is possible without the resilience provided herein for the connection to wear to the point where electrical continuity is lost. It will be appreciated that a rigid connection without resiliency may be suitable in certain applications but that it is preferable that the resilience be provided. In any case, what is desired is a tight mechanical connection wherein repetitious openings and closings of the connection or vibrations of the dipole halves will not cause excessive wearing of the connection to the point where electrical continuity is materially degraded or even broken.

Figure 10:
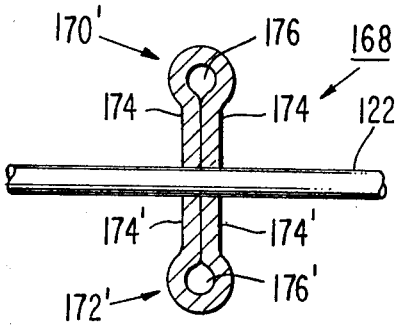
FIG. 10 is an enlarged portion of FIG. 9 illustrating the connection of the bifurcated tines of the antenna dipole element with a feed thru wire.

The bifurcated end 168 can be formed by crushing the tubular shape at the end 168 of dipole half 120 into a flat configuration. As shown in FIG. 10, this crushing can be done in a stamping operation in which the two tines 170', 172' are shaped to include crushed edges 174 and 174'. Each tine includes a tubular portion 176 and 176' at the outer end of the edges 174 and 174', providing enhanced structural rigidity to each of the tines. Crushed edges 174 and 174', respectively, provide a rigid wire contacting surface, while the tubular portions 176 and 176' provide a relatively strong structure when the tines are engaged with the feedthrough wire.

By employing a support 126, as described, in each of the assemblies such as assemblies 114 and 114' of FIG. 6, the connection of the elements 118', 120 and 118, 120' to the respective wires 122, 124 can be made with the proper phasing by simply reversing the orientation of every other support 126 on the boom 112. As best seen in FIG. 8, the wings 128 and 130 of assemblies 114 and 114' extend on different levels in diametrically opposite directions. This facilitates the connection of element 118' to wire 122, where the next adjacent element 118 extending in the same direction is connected to wire 124, and the connection of element 120' to wire 124 where the next adjacent element 120 extending in the same direction is connected to wire 122. The elements of additional assemblies (not shown) on the boom 112 would be connected in a similar manner.

Figure 11:
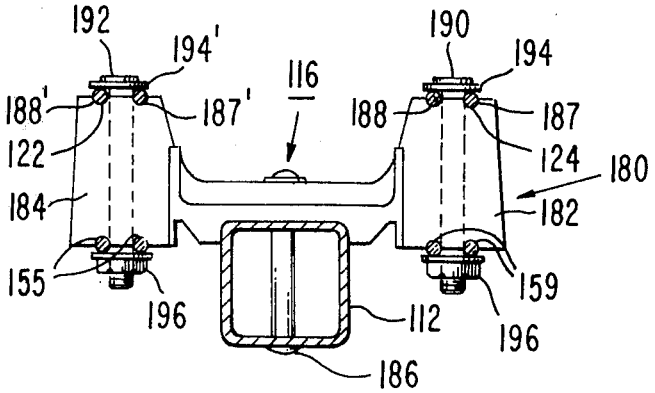
FIG. 11 is a sectional elevation view taken along lines 11 — 11 of FIG. 6 illustrating the termination of the feed thru wires.

The ends of the feedthrough wires 122 and 124 are terminated by a suitable support assembly 116 which anchors one end of the feedthrough wires and provides electrical terminal connections for a suitable cable or transmission line or to a UHF feed line as illustrated in FIGS. 1 and 2. The termination of the feedthrough wires 122 and 124 is best seen in FIG. 11 illustrating the feedthrough wire support assembly 116. Assembly 116 is a molded thermoplastic single, integral unit 180 comprising a pair of wings 182 and 184. The unit 180 is riveted to the boom 112 by rivet 186. Formed at the upper surface of the upstanding portions of wings 182 and 184 are a pair of feedthrough wire receiving grooves 187 and 188 in wing 182 and grooves 187' and 188' in wing 184, respectively. A metal bolt, rivet or other suitable mechanically and electically connecting fastener 190 and 192, respectively extends through each of the wings 182 and 184. The heads of fasteners 190 and 192 are mounted with suitable metal washers 194 and 194' which clamp the feedthrough wires 124 and 122, respectively, in the grooves. The fasteners 190 and 192 can also mount the hairpin-shaped conductors 155 and 159 which provide the UHF decoupling discussed previously in connection with FIGS. 4 and 5.

In operation to close the element 118 in a folded position for convenience of packaging and handling, the antenna detent spring-loaded portion 160 is moved in the upward vertical direction (FIGS. 7 and 8) until portion 160 clears surface 128' of wing 128. At that time, the element 118 may be rotated in the direction 162 above rivet 148 wherein the detent portion 160 rests on the edges of surface 128' adjacent recess 144. The bifurcated end 166 will have been rotated clear and free of the feedthrough wire 124. To facilitate the free movement of the element 118, the surface 128' of the wing 128 can be stepped or otherwise cut away to permit the end 166 to move freely over the surface 128'.

To place the element 118 in use, the element need only be rotated until the detent portion 160 engages recess 144 and the bifurcated end 166 engages the feedthrough wire 124. At this time the element is secured and is extended in its normal operational configuration. The relatively stiff wire 124 suspended between stanchions 134 and 136 resists the bending forces produced by element 118 when rotated into engagement with the wire. Also, the wire is sufficiently rigid to provide good electrical contact with end 166 without substantial deleterious cold working of the wire. The spacing of the stanchions 134 and 136, while not critical, is determined to provide lateral support to the wires when the elements are rotated into and out of engagement therewith between the stanchions. By way of example, the stanchions as used in one application of the invention were spaced about two and a half inches (63.5 mm) apart with wires 122 and 124 about 3.175 mm in diameter.

The wires 122 and 124 being disposed on the same side of boom 112, one above the other, and being straight and parallel along the length of the boom provide a simple and economical antenna construction not heretofore possible. A simple rotation of each of the dipole elements provides a good electrical connection with few parts.

What is claimed is:

1. An antenna system comprising an elongated boom, a plurality of dipoles each comprising a pair of elongated dipole half elements mounted on and electrically insulated from said boom, a feed line for said dipoles including first and second conductors with said first conductor spaced between the second conductor and the boom and with said conductors extending along said boom substantially parallel to each other and to said boom to maintain a constant impedance feed line along said boom, each of said dipoles extending transverse the elongated axis of the boom and symmetrically disposed about said axis with the dipole half elements of each dipole connected to a different one of said first and second conductors.

2. The combination claimed in claim 1, wherein the dipole half elements extending from the same side of said axis of said boom are successively connected alternately to said first and second conductors.

3. The combination claimed in claim 1 wherein said first and second conductors are spaced above the boom in a plane perpendicular to top surface of the boom.

4. An end fire UHF and VHF antenna system comprising: an elongated boom, a plurality of conductive elements extending in a common plane conductively mounted across the boom near one end of the boom and adapted to receive signals within a UHF band of frequencies, a plurality of varying length dipoles each comprising a pair of dipole half elements mounted on and electrically insulated from said boom near the other end of said boom opposite said one end; said dipoles increasing in length toward said other end and adapted to receive signals within a VHF band of frequencies, feed means including a pair of conductors extending along one side of the boom from a feed point near said one end to the longest length dipole, said pair of conductors in the region of said conductive elements extending equidistant from the boom, parallel to each other in a given plane and in close proximity to said conductive elements to form a proximity feed for said conductive elements, said pair of conductors in the region of said dipoles extending parallel and one above the other relative to the boom and in a plane orthogonal to said given plane, said dipoles extending transverse the elongated axis of said boom and symmetrically disposed about said axis with the dipole half elements on the same side of said axis of said boom successively connected alternately to said first and second conductor.

5. The combination claimed in claim 4 including a parasitic element closely spaced to at least one of said dipoles.

6. The combination claimed in claim 5, wherein said conductive elements are approximately one-half wavelength long at a frequency within the UHF television band of frequencies.

7. The combination claimed in claim 5 wherein the shorest length dipole is approximately one wavelength long at a frequency slightly above the high end of the high VHF television frequency band and a director element is closely spaced from said shortest length dipole and is approximately a half wavelength long at a frequency in the high VHF television frequency band.

8. The combination claimed in claim 4 including UHF decoupling means coupled to said conductors between said shortest length dipole and said conductive elements.

* * * * *

UNITED STATES PATENT OFFICE

CERTIFICATE OF CORRECTION

PATENT NO. : 3,984,841

DATED : October 5, 1976

INVENTOR(S) : Peter John Mikulich, Jr. et al

It is certified that error appears in the above-identified patent and that said Letters Patent are hereby corrected as shown below:

In the Specification:

| | | |
|---|---|---|
| Col. 2, | line 67 | reads "broom", should be -- boom --. |
| Col. 3, | line 5 | reads "deloyed", should be -- deployed --. |
| Col. 3, | lines 9 and 10 | reads "17, 19, 21 and 25", should be -- 17, 19, 21, 23 and 25--. |
| Col. 5, | line 17 | reads "21", should be -- 31 --. |
| Col. 5, | line 22 | reads "conducted", should be -- conductor --. |
| Col. 6, | line 25 | reads "planne", should be -- plane --. |
| Col. 7, | line 28 | reads "thee", should be -- the --. |
| Col. 7, | line 43 | reads "apertues", should be -- apertures --. |
| Col. 7, | line 63 | reads "thhe", should be -- the --. |

Signed and Sealed this

Fourteenth Day of December 1976

[SEAL]

*Attest:*

RUTH C. MASON
*Attesting Officer*

C. MARSHALL DANN
*Commissioner of Patents and Trademarks*